United States Patent [19]

Kane et al.

[11] Patent Number: 4,663,502

[45] Date of Patent: May 5, 1987

[54] AUXILIARY CONTACT

[75] Inventors: Hugh Kane, Fort Mill; Walt Landow, Lancaster, both of S.C.

[73] Assignee: Joslyn Corporation, Chicago, Ill.

[21] Appl. No.: 817,588

[22] Filed: Jan. 10, 1986

[51] Int. Cl.[4] ..... H01H 9/02

[52] U.S. Cl. ..... 200/5 R; 335/132; 335/198

[58] Field of Search ..... 200/5 R, 307, 153 T; 335/132, 198

[56] References Cited

U.S. PATENT DOCUMENTS 2,413,130 12/1946 Aitken ..... 200/153 T 4,356,368 10/1982 Osika ..... 335/132

*Primary Examiner*—A. D. Pellinen

*Assistant Examiner*—Morris Ginsburg

*Attorney, Agent, or Firm*—Mason, Kolehmainen, Rathburn & Wyss

[57] ABSTRACT

An auxiliary contact for field or factory addition to a contactor or motor starter of the type including a housing wall and an operator element movable between alternate positions upon activation. The auxiliary contact includes a body of insulating material adapted to be detachably mounted on an outside surface of said housing wall of the contactor adjacent the movable operator element thereof. A fixed electrical contact is mounted in the body and includes an externally accessible connector and a movable electrical contact also mounted in the body, includes an externally accessible connector. The movable contact includes a cam that is positioned to engage the operator element upon movement thereof in order to make and break contact with the fixed contact in response to activation of said operator element. The auxiliary contact includes a system for preselecting a normally open or a normally closed switching function between the fixed and movable contacts and a plurality of pairs of independently preselectable contacts may be provided in a single auxiliary contact adapted to be mounted on the housing wall of a contactor.

17 Claims, 6 Drawing Figures

AUXILIARY CONTACT

BACKGROUND OF THE INVENTION

1. Field of the Invention

The present invention relates to auxiliary contacts and more particularly to an auxiliary contact of the type especially adapted for field application or factory application to an electrical contactor or motor starter. In particular, the auxiliary contact of the present invention is adapted for use as an addition to a contactor or motor starter of the type including a housing wall and an operator element which is movable between alternate operative positions upon activation of the contactor.

2. Description of the Prior Art

In electrical switching apparatus and circuitry including electromagnetic contactors or motor starters, it is often desirable to provide one or more sets of auxiliary contacts having either a normally open or a normally closed switch function to operate in unison with the motor starter or contactor. Oftentimes when additional switching is needed, additional wiring becomes messy and requires more additional space than is normally available in a junction box or circuit box wherein the main contactor or motor starter is mounted. Many times such auxiliary contacts are fabricated in the field on an ad hoc basis and consequently are of a non-uniform or non-standardized variety so that subsequent servicing and circuit tracing functions were difficult.

OBJECTS OF THE INVENTION

It is an object of the present invention to provide a new and improved auxiliary contact for addition to an electrical contator such as a motor starter or the like.

Yet another object of the present invention is to provide a new and improved auxiliary contact especially adapted for application in the field or at the factory to an ordinary contactor or motor starter in order to provide additional switching functions responsive to the activation of the contactor.

Yet another object of the present invention is to provide a new and improved auxiliary contact of the character described which is mechanically interconnectable with an existing contactor or motor starter.

Still another object of the present invention is to provide a new and improved auxiliary contact of the character described which occupies a minimal amount of additional space when attached in an operative position on a motor starter or contactor.

Yet another object of the present invention is to provide a new and improved auxiliary contact of the character described which has a capacity of multiple switching functions including either a normally open or a normally closed type of operation.

Still another object of the present invention is to provide a new and improved auxiliary contact of the character described which includes externally readable indicia for enabling an installer or service-man to easily select a normally open or a normally closed switching function.

Yet another object of the present invention is to provide a new and improved auxiliary contact of the character described wherein plural switches are provided, each switch being independent of the other to provide a normally open or a normally closed switching function responsive to the activation or operation of a common motor starter or contactor on which the auxiliary contact is attached.

Yet another object of the present invention is to provide a new and improved auxiliary contact of the character described which is neat in appearance, compact in size and easily attached to mechanically interconnect with a main contactor or motor starter.

Yet another object of the present invention is to provide an auxiliary contact of the character described which is modular in nature and which can be attached and installed on a contactor or existing motor starter with a minimum of labor and without any modification of the primary contactor or motor starter being required.

Another object of the present invention is to provide an auxiliary contact of the character described which may be readily detached from a main contactor or motor starter when needed without effecting the function thereof.

BRIEF SUMMARY OF THE INVENTION

The foregoing objects of the present invention are accomplished in an illustrated embodiment comprising a new and improved auxiliary contact especially adapted for addition to a contactor or motor starter of the type including a housing wall and an operator element movable between alternate operative positions upon activation of the contactor. The auxiliary contact in accordance with the invention includes a body of insulating material adapted for detachable mounting on an outside surface of the contactor housing wall adjacent the movable operator element. The auxiliary contact includes one or more switches comprising a fixed electrical contact mounted in the body having an externally accessible connector and a movable electrical contact also mounted in the body including a similar externally accessible connector. The movable contact is adapted for operative engagement with the operator element of the contactor or motor starter and is positioned relative thereto within the body of the auxiliary contact so as to make and/or break electrical contact with the fixed contact in response to movements of the operator element between alternate operative positions. Preferably, a plurality of switches are provided in the body of the auxiliary contact, each switch including a fixed and a movable contact combination. Each movable contact of each switch is individually selectively controllable to provide a normally open or a normally closed switching function when operatively associated with a contactor or motor starter. The auxiliary contact is compact in size and the external contacts thereof are easily accessible for electrical hook up to control various electrical apparatus as required.

BRIEF DESCRIPTION OF THE DRAWINGS

For a better understanding of the present invention, reference should be had to the following detailed description taken in conjunction with the drawings, in which.

DETAILED DESCRIPTION OF A PREFERRED EMBODIMENT

Figure 1:
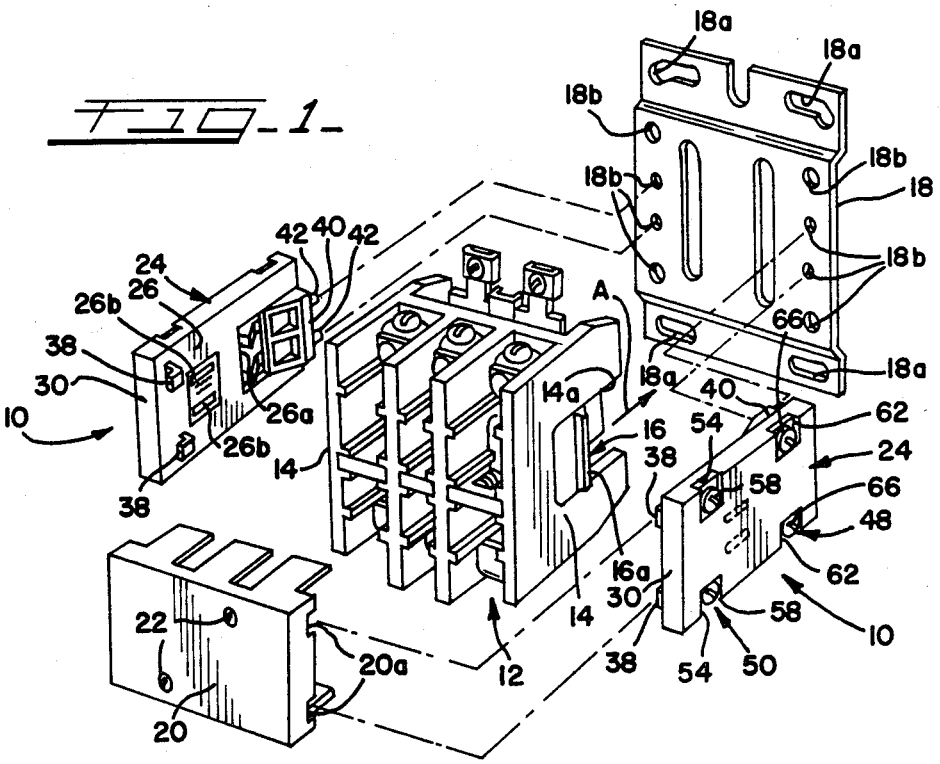
FIG. 1. is an exploded, front elevational, perspective view illustrating a typical contactor or motor starter in combination with a pair of auxiliary contacts in accordance with the present invention and a common mounting plate for securing the combination on a panel or surface of a junction box.

Referring now more particularly to the drawings, therein is illustrated a new and improved auxiliary contact referred to generally by the reference numeral 10 and especially designed and adapted for addition to a contactor or motor starter 12 (FIG. 1) of the type having outer sidewalls 14 and a solenoid actuated operator element 16 having a rib 16*a* projecting outwardly of the face of the adjacent outer sidewalls 14. The rib is adapted to move within a rearwarly open ended slot 14*a* from a first position as shown in solid lines in FIGS. 1 and 4 in a direction indicated by the arrows A to a second position, (dotted lines FIG. 4) upon activation of the solenoid coil in the contactor when energized for starting a motor or the like.

The contactor 12 as illustrated is a typical three phase AC contactor in common use for starting motors and the like. Oftentimes it is desirable to have one or more additional switching functions performed simultaneously with the operation of the contactor and the auxiliary contact 10 of the present invention is especially designed for this purpose.

The contactor 12 is adapted to be mounted on and/or include a mounting plate or base 18 (FIG. 1), which plate typically includes a plurality of upper and lower elongated slots 18*a* for facilitating the mounting of the contactor on a rail within a junction or control box. In addition, the mounting plate is provided with a plurality of apertures 18*b* aligned in parallel columns spaced along opposite side edges thereof. Central pairs of the apertures 18*b* are used in conjunction with the auxiliary contact 10 for securing the auxiliary contact in position on one or both of the respective opposite sidewalls 14 of the contactor 12.

The contactor 12 also includes a removable front wall member 20 secured in place with cap screws 22 and formed with spaced apart slots 20*a* on opposite side edges for use in securing the auxiliary contacts 10 in place at the forward or outer edge thereof.

Figure 4:
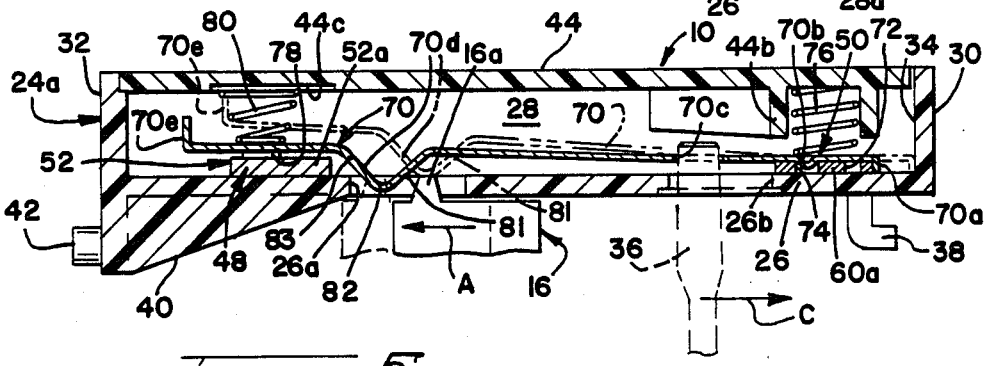
FIG. 4 is a longitudinal cross-sectional view of the auxiliary contact taken substantially along lines 4—4 of FIG. 2.

In accordance with the present invention, the auxiliary contact 10 includes a generally rectangular body 24, preferably formed of molded plastic material, and having good electrical insulating characteristics. The body is formed with a base or bottom wall 26 adapted to directly face and confront the outer surface of a sidewall 14 of the contactor 12. The body further includes a pair of sidewalls 28 along opposite longitudinal edges of the base, a front wall 30 and a rear wall 32 all of which walls project outwardly from the bottom wall to form a hollow interior space 34 for accommodating the electrical operative components of the auxiliary contact as will be described in more detail hereinafter. The bottom wall 26 of the auxiliary contact body is formed with a relatively large rectangular shaped opening 26*a* in order that the rib 16*a* of the operator 16 can project inwardly into the interior of the contact body as shown in FIG. 4 for actuating the switch elements therein. The bottom wall is further provided with a plurality of small, rectangular, longitudinally extending, spaced apart tool access slots 26*b* in order that the blade of a screwdriver 36 may be inserted into the hollow interior space 34 for selective adjustment of the switch functions of the electrical components therein.

For the purpose of securing an auxiliary contact 10 permanently in place on the sidewall 14 of the motor starter or contactor 12, a pair of L-shaped projections or hooks 38 are integrally formed to extend outwardly of the bottom wall 26 adjacent the forward end wall 30 and these projections are adapted to interlockingly engage the front wall 20 of the contactor 12 in the slots 20*a* provided therein to hold the forward end portion of the auxiliary contact tightly in place.

At the rearward end, the bottom wall 26 is provided with an outwardly extending wedge shaped projection 40 having a pair of rearwardly projecting cylindrically shaped bosses or pins 42 adapted to seat within a central pair of the apertures 18*b* in the mounting plate 18 to positively secure the rear end portion of the auxiliary contact 10 in place (FIG. 1). The locking wedge 40 of the auxiliary contact 10 is adapted to extend into the rearwardly open slot 14*a* in either sidewall 14 of the contactor 12 and this provides a key-like interlock to properly position the auxiliary contact in place when mounted on the contactor. This keyed interlock insures that the operating element 16 and rib 16*a* is positioned within the rectangular slot 26*a* of the bottom wall 26 for operation of the electrical switch components contained in the auxiliary contact.

Figure 2:
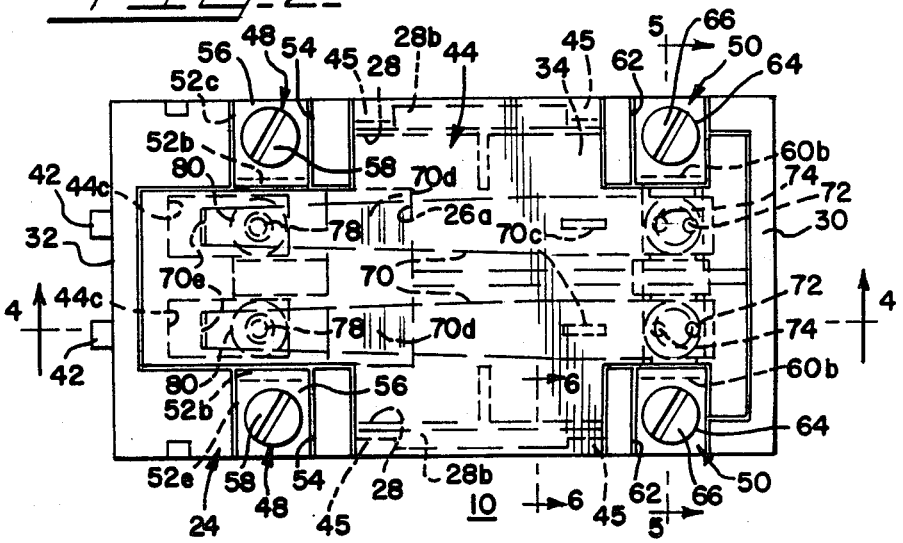
FIG. 2 is a side elevational view of a new and improved auxiliary contact constructed in accordance with the features of the present invention.
Figure 3:
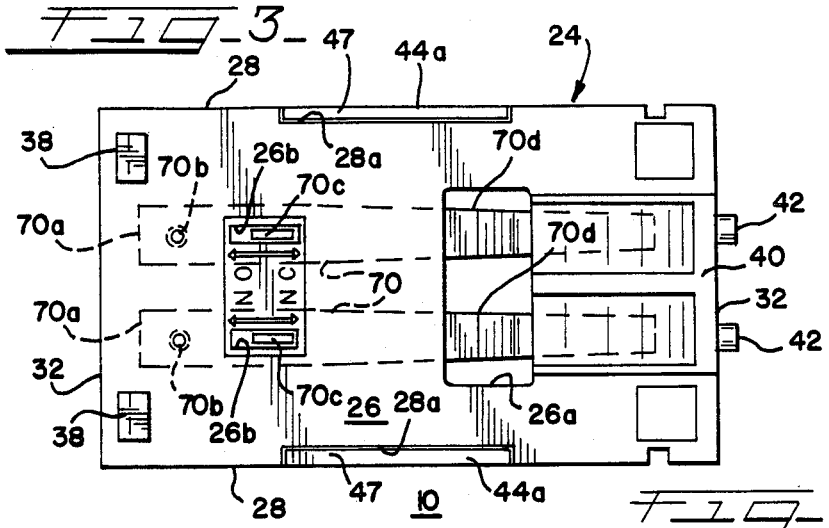
FIG. 3 is a side elevational view of an inside face of the auxiliary contact.
Figure 6:
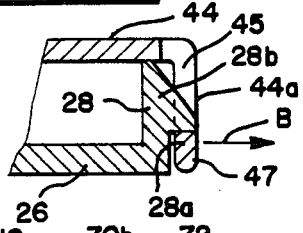
FIG. 6 is a fragmentary transverse cross-section view of the auxiliary contact taken substantially along lines 6—6 of FIG. 2.

In order to provide access to the interior space 34 after an auxiliary contact 10 is mounted in place and secured to the contactor 12 as described, the contact body 24 includes a removable cover 44 preferably formed of molded plastic material having good electrical insulating characteristics and preferably transparent so that the interior of the body and components therein can be viewed from the outside. As shown in FIGS. 2 and 6, the removable cover 44 is provided with a pair of depending sidewall structures 44*a* on opposite sides spaced intermediate the ends of the cover. As best shown in FIGS. 3 and 6, each sidewall structure includes a pair of depending legs 45 joined together at the lower end by an elongated rib 47 and each sidewall 28 of the body 24 is formed with a slot 28*a* intermediate the ends to accommodate a rib 47 which locks into place against the lower edge of a wedge shaped portion 28*b* formed on the mid portions of the adjacent body sidewall. The legs 45 and rib 47 are adapted to be deflected outwardly as indicated by the arrow B (FIG. 6) as the removable cover 44 is snapped downwardly into place and when the upper edge of the ribs 47 clear the lower edge of the wedge shaped portions 28*b* of the sidewalls, the legs and rib then snap back into interlocking relation to hold the removable cover in place and fully close the interior space 34 of the body 24.

In accordance with the present invention, the auxiliary contact 10 includes one or more switches, each including a fixed and a movable switch contact 48 and 50, respectively, and each switch is selectively adjustable to provide a normally open or a normally closed switch function as desired. Each fixed contact 48 includes a Z-shaped contact member 52 having a base segment 52*a* (FIG. 4) mounted on the bottom wall 26, an upstanding intermediate leg 52*b* (FIG. 2) and an outwardly extending external leg 52c parallel of and spaced upwardly from the base segment 52a seated within an integrally formed, rectangular recess 54 provided in the upper surface of the insulating body 24 (FIG. 2). Each fixed contact 48 also includes a rectangular shaped, wire clamping washer 56 and a cap screw 58 for providing easy external connections to the contacts of the switch.

Each movable contact 50 includes means for making electrical connection thereto externally of the body 24 comprising a Z-shaped member 60 (FIG. 4) having a base or lower segment 60a seated against the surface of the housing bottom wall 26. The Z-shaped member also includes an upstanding intermediate leg 60b and an outwardly extending leg 60c parallel of the base segment and projecting into a rectangular recess 62 integrally formed in the housing body. A square or rectangular shaped wire clamping washer 64 is mounted in the recess 62 along with a cap screw 66 for securing external wiring to the switch contact.

Figure 5:
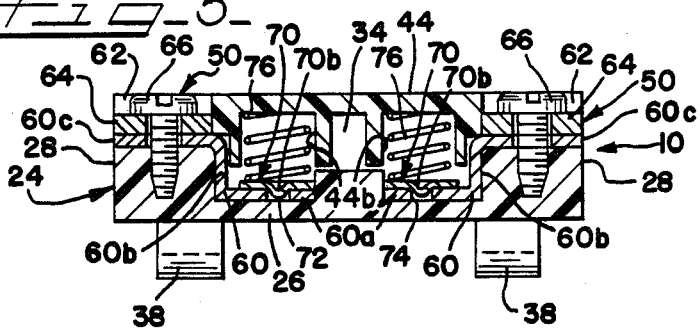
FIG. 5 is a transverse cross-sectional view of the auxiliary contact taken substantially along lines 5—5 of FIG. 2.

Each movable contact 50 includes an elongated, thin, flexible reed-like contact element 70 extending generally parallel of the sidewalls 28 between the respective base segments 60a and 52a of the Z-shaped contact members 60 and 52. At a fixed end, each reed 70 is provided with a downturned end tab 70a and a downwardly projecting detent or dimple 70b of circular configuration is spaced longitudinally inwardly from the fixed end of the member as shown in FIGS. 3, 4 and 5. The detent 70b is adapted to seat into a selected one of a pair of apertures 72 and 74 of circular shape provided in the base segment 60a of the Z-shaped member 60 and spaced apart longitudinally with respect to the length of the reed. As will be developed more fully hereinafter, and referring specifically to FIG. 4, when the detent dimple 70b of a reed 70 is positioned in the aperture 72, as shown in dotted lines, a normally open switch function is provided and when the detent is shifted longitudinally and seated in the recess or aperture 74 as shown in solid lines, a normally closed switch function is provided.

Each reed 70 is formed with an elongated slot 70c dimensioned to receive the blade of a screw-driver 36 when extended inwardly into the interior space 34 through an adjacent wall slot 26b as shown in FIG. 4. Movement of the screwdriver blade engaged within the slot in the direction of an arrow C will move the detent 70b to become seated in the aperture 72 when a normally open switch function is selected. The tang or tab 70a on the outer end of the reed 70 engages the inside surface of the forward end wall 30 as shown to prevent further travel of the reed contact in the direction of the arrow C and this stopping engagement properly centers the detent 70b within the outermost aperture 72 of the contact segment 60a.

Continuous contact between the longitudinally shiftable detent end portion of the reed 70 and the Z-shaped contact member 60 is maintained by a coil spring 76 having an upper end portion seated within a downwardly depending, hollow boss 44b integrally formed on the removable cover 44. The lower end coil of the spring bears directly on the upper surface of the reed 70 to provide low resistance, continuous electrical contact between the reed and the Z-shaped member 60.

The apertures or slots 26b in the bottom wall 26 of the housing body 24 are provided with identifying indicia on the outside surface of the bottom wall as shown in FIG. 3. This indicia comprises the designation "NO" for a normally open switch function and "NC" for a normally closed switch function. Double-headed arrows are provided to indicate the respective directions of shifting of the reeds 70 to obtain a normally closed or a normally open switching function.

Preselected longitudinal shifting of the elongated flexible reeds 70 in the manner just described is usually accomplished before an auxiliary contact 10 is mounted on the contactor or motor starter 12 because once the auxiliary contact is secured in place, the selected switch function is generally permanent until the auxiliary contact is removed. However, because the cover 44 is formed of transparent plastic material, the position of the screwdriver slot 70c and the dimple detent 70b of each reed 70 can always be readily seen to determine if a reed is in a normally open functional position or a normally closed functional position.

Each elongated, flexible, reed 70 includes a cam portion 70d of generally V-shaped configuration (as shown in FIG. 4) adapted for operative engagement with the rib 16a on the operator element 16 of the contactor or motor starter 12 on which the auxiliary contact 10 is mounted. Outwardly of the V-shaped cam segment 70d at an outer end, the reed 70 includes an upstanding end tab 70e, and each reed is provided with a contact button or rivet-like element 78 spaced between the cam segment and outer end adapted to make and break contact with the adjacent segment 52a of the cooperative fixed contact 48. The contact button 78 is biased toward the segment 52a by means of a conical shaped coil spring 80 having a small diameter end coil secured to the contact button and a large diameter, opposite end coil bearing against the surface of a shallow rectangular recess 44c provided on the inside face of the removable cover 44 as shown in FIG. 4. The movable outer end portion of the reed 70 is thus continuously biased toward the surface of the segment 52a of the fixed contact 48, and this arrangement provides a normally closed switch function when the reed is in the position shown in solid lines in FIG. 4.

As therein illustrated, the rib 16a of the operating element of the contactor does not engage the V-shaped cam 70d of the reed until the contactor is energized causing the operator element 16 to move in the direction of the arrow A. When this occurs, the rib 16a engages a first, downwardly sloping cam surface 81 and biases the outer end portion of the reed and the contact button 78 to break electrical contact with the segment 52a against the force of the conical bias spring 80. When the solenoid of the contactor 12 is subsequently deenergized and the operator element 16 returns to the normal position as shown in solid lines (FIG. 4), the rib 16a moves out of holding engagement with a cam surface 82 at the apex of the V-shaped cam segment 70d and when this occurs, the conical coil spring 80 then is effective to again make electrical contact between the contact button 78 and the adjacent fixed contact segment 52a.

The V-shaped cam segment 70d of the reed 70 also includes an opposite, upwardly sloping cam surface 83 extending between the apex 82 and the outer end portion of the reed. When the position of the reed 70 is longitudinally shifted from the position which provides a normally closed switch function as shown in solid lines (FIG. 4) to a position for providing a normally open switch function as shown in dotted lines, the apex 82 of the cam section 70d is moved into direct contact with the outer surface of the operator rib 16a when the contactor 12 is in a deenergized condition. This engagement maintains the contact button 78 out of electrical contact with the fixed contact segment 52*a* and the switch is retained in the normally open condition until such time as the contactor 12 is energized moving the rib 16*a* in the direction of the arrow A to the position shown in dotted lines wherein the rib is moved away from engagement with any portion of the V-shaped cam segment 70*d*.

Subsequently, upon deenergizing of the contactor 12 and return of the operator rib 16*a* to the original position, the rib engages the cam surface 83 and deflects the outer end portion of the reed 70 away from the contact segment 52*a* to break electrical contact and again assume a normally open switch position.

In an emergency, if it is desired to change a switch function from a normally open to a normally closed operation or vice versa after the auxiliary contact 10 has been fixedly mounted on the contactor 12 as previously described, the screws 22 may be loosened and the front wall member 20 disengaged from the hooks 38 so that the body 24 of the auxiliary contacts 10 can be pivoted outwardly away from the sidewall 14 of the contactor 12. When the forward end of the body of an auxiliary contact is pivoted far enough away to expose the slots 26*b* in the bottom wall, a short screw driver may be inserted into the slots 70*c* to shift the reeds 70 to a desired functional position. After the desired reed position change is selected, the body 24 of the auxiliary contacts are then pivoted back to the original attached position and the hooks 38 are engaged in the slots 20*a* of the front wall member 20 and the screws 22 retightened.

Many modifications and variations of the present invention are possible in light of the above teachings. Thus, it is to be understood that, within the scope of the appended claims, the invention may be practiced otherwise than as specifically described above.

What is claimed and desired to be secured by Letters Patent is:

1. Auxiliary switching apparatus adapted to be mounted on a contactor of the type including a housing wall and an operator element movable between alternate operative positions upon activation of said contactor, said auxiliary switching apparatus comprising:

a body of insulating material adapted for detachable mounting on an outside surface of said housing wall of said contactor adjacent said movable operator element;

at least one switch enclosed in said body, said switch comprising a fixed electrical switch contact mounted in said body and including an externally accessible connector and a movable electrical switch contact mounted in said body and including an externally accessible connector, said movable switch contact adapted to be directly operatively engaged by said operator element of said contactor and positioned in said body to make and break electrical contact with said fixed switch contact in response to movement of said operator element of said contactor between said alternate operative positions, said movable switch contact comprising an elongated flexible member having one end portion movable for making and breaking electrical contact with said fixed switch contact and an opposite end portion in continuing electrical contact with said externally accessible connector thereof, said flexible member including a cam portion formed intermediate said end portions and adapted to be engaged directly by said operator element of said contactor to move said one end portion relative to said fixed contact in response to movement of said operator element between said alternate operative positions;

said body being adapted for mounting on said contactor in a position wherein said operator element of said contactor moves longitudinally of said elongated flexible member along a path generally parallel thereof between first and second positions, said cam portion of said flexible member including at least a first cam surface extending into said path for operative engagement with said operator element of said contactor during said movement, and means for shifting said elongated flexible member between longitudinally spaced first and second operative positions for providing preselectable normally open and normally closed switching functions, between said fixed and movable switch contacts.

2. The apparatus of claim 1 wherein said body includes an operator access opening formed in a wall thereof adapted to face said housing wall of said contactor when said switching apparatus is mounted thereon, said access opening in said wall of said body being located so as to permit said movable operator element of said contactor to extend into said body and directly engage said cam portion of said elongated flexible member.

3. The apparatus of claim 1 wherein said cam portion is engaged with said operator element of said contactor in said first position and is disengaged therefrom upon movement of said operator element of said contactor toward said second position when said elongated flexible member is positioned in said first longitudinally spaced position for providing a normally open switching function between said fixed and movable switch contacts.

4. The apparatus of claim 1 wherein said cam portion is out of engagement with said operator element of said contactor in said first position and is engaged thereby upon movement of said operator element of said contactor toward said second position when said elongated flexible member is positioned in said second longitudinally spaced position for providing a normally closed switching function between said fixed and movable switch contacts.

5. The apparatus of claim 1 wherein said shifting means includes slot means in said elongated flexible member for receiving a tool insertable therein from the exterior of said body, said body having a tool access opening in a wall thereof for permitting the insertion of said tool into said slot for selective movement of said elongated flexible member between said first and second longitudinally operative positions.

6. The apparatus of claim 5 wherein said body includes indicia adjacent said tool access opening for indicating the direction of movement of said tool in order to provide a selected longitudinal position of said elongated flexible member for selecting between said normally open and said normally closed switching functions between said fixed and movable switch contacts.

7. The apparatus of claim 1 including detent means for retaining said elongated flexible member in one of said first and second longitudinal positions as selected.

8. The apparatus of claim 7 wherein said detent means comprises a pair of spaced recesses formed in said connector of said movable contact and spaced longitudinally apart relative to said elongated flexible member, said elongated flexible member including a detent adapted to seat in a selected one of said recesses and resilient means for biasing said detent into seated engagement with a selected recess.

9. The apparatus of claim 1 wherein said cam portion comprises a generally V-shaped bend integrally formed in said elongated flexible member providing a first cam surface sloping outwardly of longitudinally extending segments of said member on opposite sides of said bend, said first cam surface adapted to be engaged by said operator element of said contactor in response to movement thereof between first and second of said alternate positions in a direction toward said first cam surface for moving said one end portion of said elongated flexible member to break electrical contact with said fixed switch contact.

10. The apparatus of claim 9 wherein said first cam surface is positioned to be out of engagement with said operator element of said contactor in said first of said alternate positions permitting said one end portion of said elongated flexible member to make electrical contact with said fixed switch contact.

11. The apparatus of claim 9 wherein said first cam surface is engaged by said operator element of said contactor in said second of said alternate positions for maintaining said one end portion of said elongated flexible member in a position away from said fixed switch contact for breaking electrical contact therewith.

12. The apparatus of claim 1 wherein said cam portion comprises a generally V-shaped bend integrally formed in said elongated flexible member providing a second cam surface sloping outwardly of longitudinally extending segments of said member on opposite sides of said bend, said second can surface adapted to be engaged by said operator element of said contactor in response to movement therein between first and second alternate position in a direction toward said second cam surface for moving said one end portion of said elongated flexible member to make electrical contact with said fixed contact.

13. The apparatus of claim 12 wherein said second cam surface is positioned to be out of engagement with said operator element of said contactor in said second of said alternate positions for permitting said one end portion of said elongated flexible member to make electrical contact with said fixed switch contact.

14. The apparatus of claim 12 wherein said second cam surface is engaged by said operator element of said contactor in said first of said alternate positions for maintaining said one end portion of said elongated flexible member in a position away from said fixed switch contact for breaking electrical contact therewith.

15. The apparatus of claim 1 including a plurality of said switches in said body, each switch including at least one of said fixed electrical switch contacts and at least one of said movable switch contacts comprising at least one pair of cooperating fixed and movable switch contacts, each pair of said fixed and movable cooperating switch contacts of each switch being operable independent of other pairs in response to movement of said operator element of said contactor to make and break electrical contact.

16. The apparatus of claim 15 wherein said movable switch contact of each pair of fixed and movable switch contacts is shiftable between a first and a second position for providing preselectable normally open and normally closed switching functions with a fixed switch contact of said pair.

17. The apparatus of claim 16 wherein said movable switch contact of one pair is shiftable independently of the movable contact of another pair for providing the same and different switching functions in response to movement of said operator element of said contactor.

* * * * *